US005511327A

United States Patent [19]

Jurkowski et al.

[11] Patent Number: 5,511,327

[45] Date of Patent: Apr. 30, 1996

[54] WHEELED SNOW SHOVELLING DEVICE

[76] Inventors: Marlin G. Jurkowski; Kevin S. Jurkowski, both of 41609 Belknap, Clinton Twp., Mich. 48038

[21] Appl. No.: 305,551

[22] Filed: Sep. 14, 1994

[51] Int. Cl.[6] ..... E01H 5/02

[52] U.S. Cl. ..... 37/285; 37/265; 294/54.5

[58] Field of Search ..... 37/233, 263, 264, 37/265, 266, 270, 285; 294/54.5, 58, 59

[56] References Cited

U.S. PATENT DOCUMENTS

| | | | |
|---|---|---|---|
| 1,514,076 | 11/1924 | Brown | 37/266 |
| 1,683,732 | 9/1928 | Selin | 37/265 X |
| 2,863,232 | 12/1958 | Steinbach et al. | 37/270 X |
| 2,867,827 | 1/1959 | Gantz | 294/54.5 X |
| 2,930,152 | 3/1960 | Pipkin | 294/54.5 X |
| 3,468,041 | 9/1969 | Mattson et al. | 37/270 X |
| 3,748,761 | 7/1973 | Chetwynde | 37/265 |
| 4,153,287 | 5/1979 | Towsend | 37/265 X |
| 4,179,828 | 12/1979 | Brunty | 37/265 X |
| 4,214,385 | 7/1980 | Baranowski et al. | 294/54.5 X |
| 4,224,751 | 9/1980 | Schoemann et al. | 294/59 X |
| 5,117,530 | 6/1992 | Rank | 37/285 X |
| 5,309,654 | 5/1994 | Mathis | 37/270 X |

FOREIGN PATENT DOCUMENTS

| | | | |
|---|---|---|---|
| 222164 | 7/1962 | Germany | 37/270 |
| 3717334 | 12/1988 | Germany | 37/265 |

*Primary Examiner*—Brian K. Green
*Assistant Examiner*—Andrea Chop

[57] ABSTRACT

A wheeled snow shoveling device comprising: a cart having a handle formed in a generally A-shaped configuration with a cross bar including a circular ring extending therefrom, the cart including a wheel with an axle positioned at its axis, the wheel including a pair of vertical support bars affixed to the axle, the wheel also including a pair of horizontal braces affixed to its axle, the lowermost extent of the lower segment of the handle being coupled to the braces; and a snow shovel having a scoop formed as a generally rectangular shaped member and molded into a semi circular configuration, the rear surface of the scoop being coupled to the free ends of the horizontal braces of the cart wheel, the scoop having a wooden shaft affixed to its rear surface, the shaft extending through the circular ring on the cross bar of the handle, the free ends of the vertical support bars being coupled to the shaft.

5 Claims, 4 Drawing Sheets

FIG 4
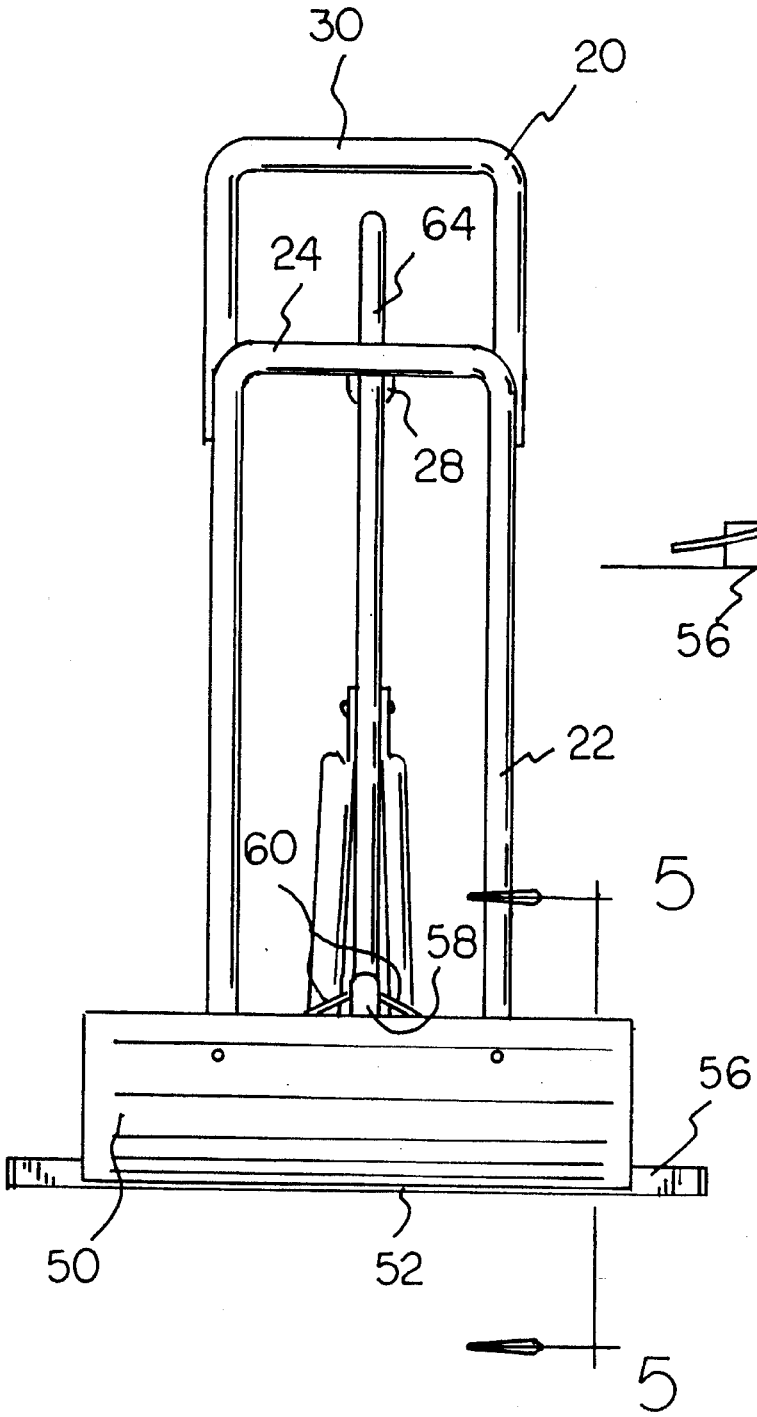
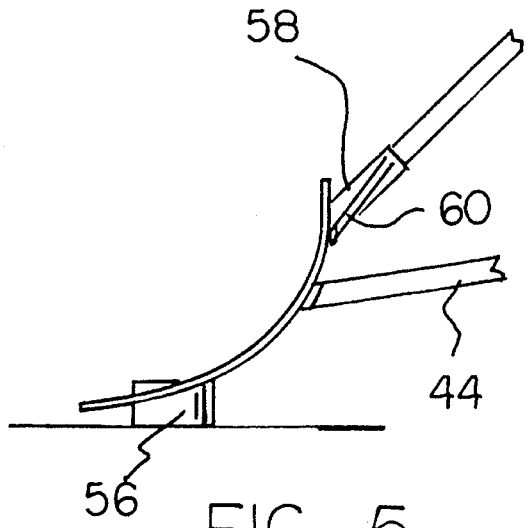
FIG 5

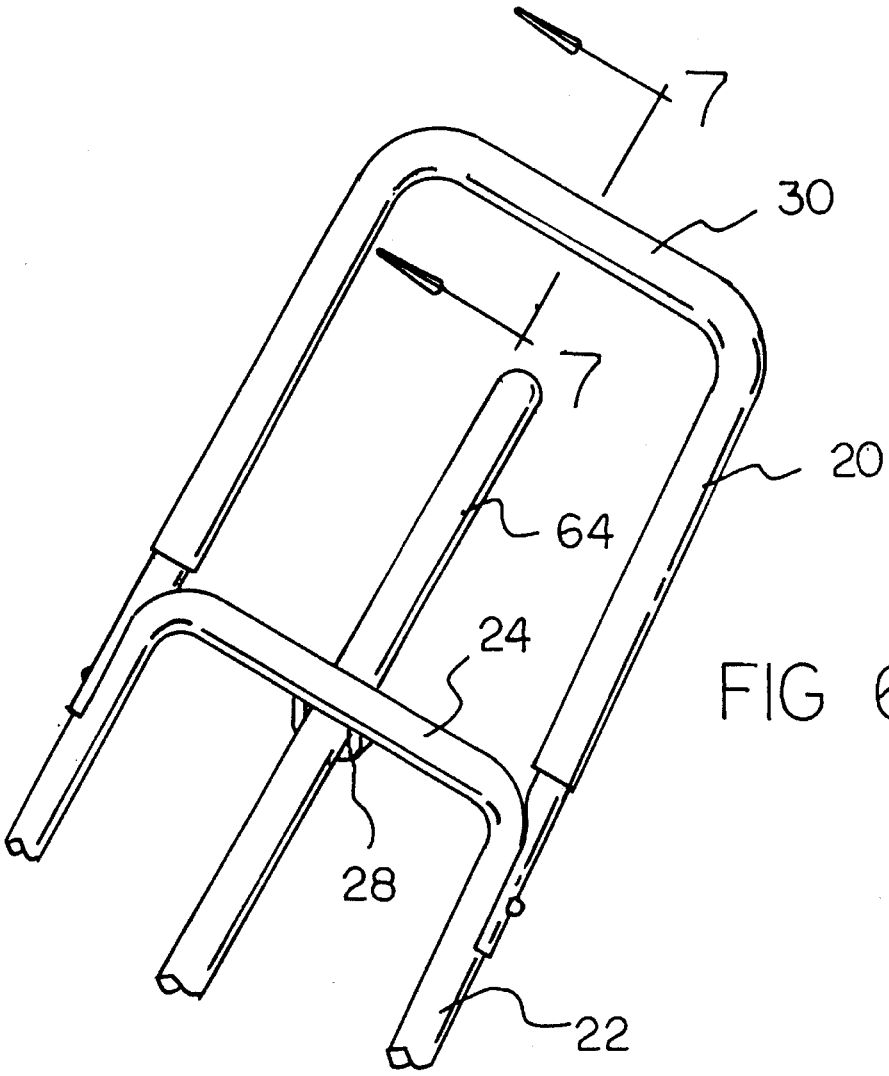
FIG 6
FIG 7
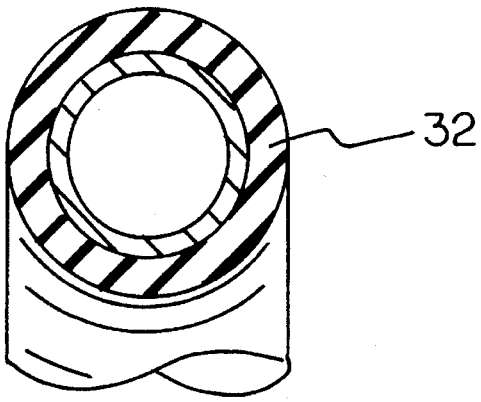

WHEELED SNOW SHOVELLING DEVICE

BACKGROUND OF THE INVENTION

1. Field of the Invention

The present invention relates to wheeled snow shoveling devices and more particularly pertains to removing snow accumulations of up to three inches with minimal effort by pushing the wheeled device across snow covered surfaces.

2. Description of the Prior Art

The use of snow removing devices is known in the prior art. More specifically, snow removing devices heretofore devised and utilized for the purpose of removing snow from various surfaces are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 5,123,187 to Zamaria a combined snow scoop and multipurpose handcart.

U.S. Pat. No. 5,074,64 to Nickels discloses a snow shovel.

U.S. Pat. No. 5,048,206 to Jones discloses a combined snow shoveling device and cart.

U.S. Pat. No. 3,643,356 to Gohl discloses a hand-operated snow removing tool.

Lastly, U.S. Pat. No. 3,469,326 to Malickson discloses a snow shoveling apparatus.

In this respect, the wheeled snow shoveling devices according to the present invention substantially depart from the conventional concepts and designs of the prior art, and in doing so provides an apparatus primarily developed for the purpose of removing snow accumulations of up to three inches with minimal effort by pushing the wheeled device across snow covered surfaces.

Therefore, it can be appreciated that there exists a continuing need for new and improved wheeled snow shoveling devices which can be used for removing snow accumulations of up to three inches with minimal effort by pushing the wheeled device across snow covered surfaces. In this regard, the present invention substantially fulfills this need.

SUMMARY OF THE INVENTION

In view of the foregoing disadvantages inherent in the known types of snow removing devices now present in the prior art, the present invention provides an improved cart mounted snow shoveling device. As such, the general purpose of the present invention, which will be described subsequently in greater detail, is to provide a new and improved wheeled snow shoveling device and method which has all the advantages of the prior art and none of the disadvantages.

To attain this, the present invention essentially comprises a new and improved wheeled snow shoveling device comprising, in combination: a cart handle having an upper segment and a lower segment, the lower segment fabricated of tubular steel and formed in a long generally inverted U-shape configuration with a horizontally positioned cross bar, the free ends of the lower segment being formed as short curved planar members with screw holes extending therethrough, the lower segment also including at least one aperture below each side of the cross bar, the cross bar including a centrally positioned downwardly extending steel ring affixed thereto, the upper segment of the handle fabricated of tubular steel and formed in a generally inverted U-shape configuration with a horizontally positioned cross bar, the free ends of the upper segment formed as planar members with at least one aperture, the upper segment of the handle being coupled to the lower segment with nuts and bolts through the aligned apertures, the entire extent of the upper segment being covered with a layer of foam rubber padding to provide a comfortable gripping surface for the user; a cart wheel formed of a solid rubber circular tire measuring between twelve and eighteen inches in diameter, a cylindrically shaped axle being positioned at the axis of the wheel, the axle including an end bolt extending from both of its free ends, a plurality of spokes connecting the axle and rubber tire therebetween, the cart wheel including a pair of vertical support bars formed in a generally tubular configuration with flat ends having circular apertures, a first free end of each vertical support bar being positioned upon an end bolt of the axle, the cart wheel including a pair of horizontal braces formed in a generally tubular configuration with flat ends having circular apertures, a first free end of each brace being positioned on an end bolt of the axle, a second free end of each brace being bent to form an L-shape configuration, the center point of each brace including a screw hole extending therethrough, the lowermost extent of the lower segment of the handle being coupled to the braces with nuts and bolts through the aligned screw holes, the first free ends of the braces and support bars being securely fastened to the axle bolts with cooperatively coupled nuts; and a snow shovel having a scoop fabricated of steel and formed as a generally rectangular shaped member molded into a semi circular configuration, the scoop having a concave front surface and a convex rear surface, the upper region of the shovel including two apertures, the rear surface of the scoop being coupled to the free ends of the braces of the cart wheel with nuts and bolts through the aligned apertures, the lowermost edge of the scoop being positioned a short distance above the ground in the operative orientation, the approximate center point of the rear surface of the scoop including a downwardly extending rubber squeegee affixed thereto, the squeegee positioned across the rear surface of the scoop with its ends extending beyond both ends of the scoop in a frontwardly angled orientation, the flexible rubber squeegee adapted to prevent the apparatus from getting caught in cracks while in use, the scoop including a hollow generally cylindrical shaped shaft mount affixed to the upper portion of its rear surface, the shaft mount including a screw hole and two angled support rods extending therefrom and affixed to the scoop, a long cylindrical shaped wooden shaft being coupled within the shaft mount with a screw, the shaft extending through the circular ring on the cross bar of the lower segment of the handle, the approximate center point of the shaft including an aperture extending therethrough, the second ends of the vertical support bars being coupled to the approximate center point of the shaft with a nut and bolt through the aligned apertures, the shaft of the snow shovel and cart handle being angled at between about thirty and sixty degrees in the operative orientation.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide new and improved wheeled snow shoveling devices which have all the advantages of the prior art snow removing devices and none of the disadvantages.

It is another object of the present invention to provide new and improved wheeled snow shoveling devices which may be easily and efficiently manufactured and marketed.

It is further object of the present invention to provide new and improved wheeled snow shoveling devices which are of durable and reliable constructions.

An even further object of the present invention is to provide new and improved wheeled snow shoveling devices which are susceptible of a low cost of manufacture with regard to both materials and labor, and which accordingly are then susceptible of low prices of sale to the consuming public, thereby making such wheeled snow shoveling devices economically available to the buying public.

Still yet another object of the present invention is to provide new and improved wheeled snow shoveling devices which provide in the apparatuses and methods of the prior art some of the advantages thereof, while simultaneously overcoming some of the disadvantages normally associated therewith.

Still another object of the present invention is to remove snow accumulations of up to three inches with minimal effort by pushing the wheeled device across snow covered surfaces.

Lastly, it is an object of the present invention to provide new and improved wheeled snow shoveling devices comprising: a cart having a handle formed in a generally A-shaped configuration with a cross bar including a circular ring extending therefrom, the cart including a wheel with an axle positioned at its axis, the wheel including a pair of vertical support bars affixed to the axle, the wheel also including a pair of horizontal braces affixed to its axle, the lowermost extent of the lower segment of the handle being coupled to the braces; and a snow shovel having a scoop formed as a generally rectangular shaped member and molded into a semi circular configuration, the rear surface of the scoop being coupled to the free ends of the horizontal braces of the cart wheel, the scoop having a wooden shaft affixed to its rear surface, the shaft extending through the circular ring on the cross bar of the handle, the free ends of the vertical support bars being coupled to the shaft.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 4 is a front perspective view of the apparatus shown in FIG. 3.

FIG. 5 is a cross sectional view of the apparatus shown in FIG. 3.

FIG. 6 is a broken away perspective view of the handle of the apparatus.

FIG. 7 is a cross sectional view of the upper segment of the handle illustrating the foam rubber padding positioned therearound.

The same reference numerals refer to the same parts through the various Figures.

DESCRIPTION OF THE PREFERRED EMBODIMENT

Figure 1:
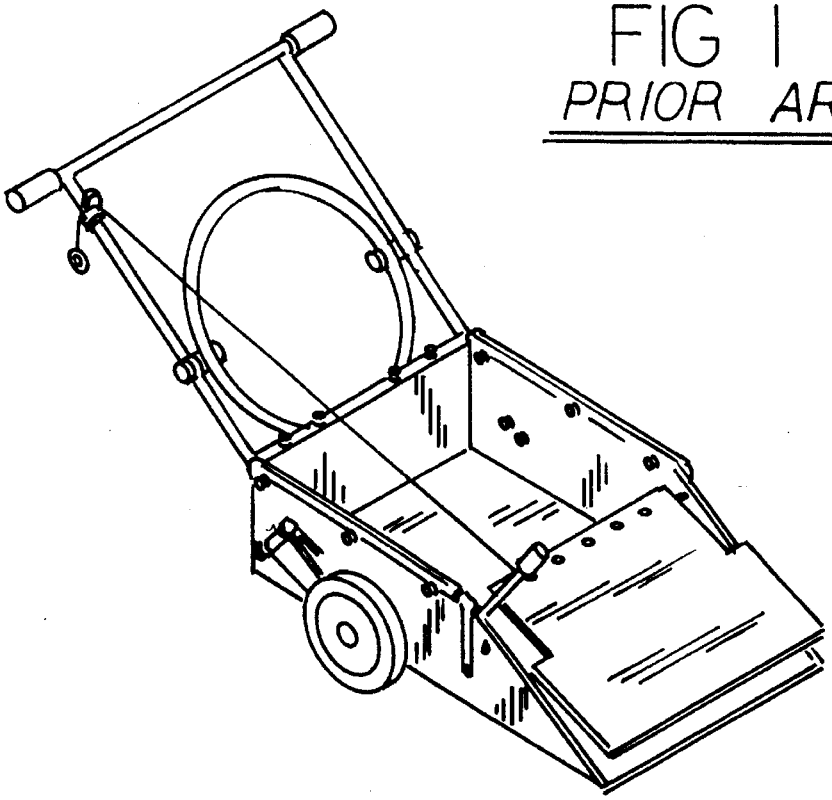
FIG 1 PRIOR ART
FIGS. 1 and 2 are perspective illustrations of prior art snow removing devices.
Figure 2:
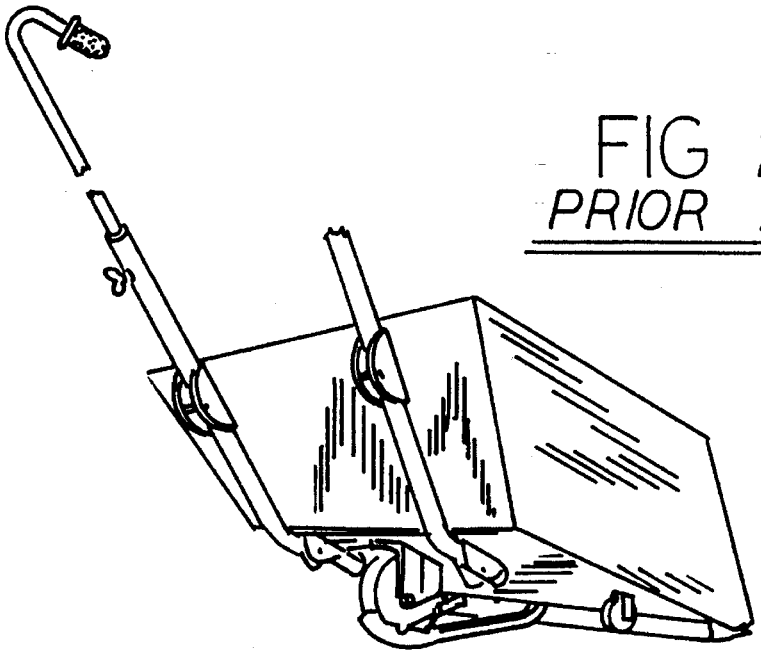
FIG 2 PRIOR ART
Figure 3:
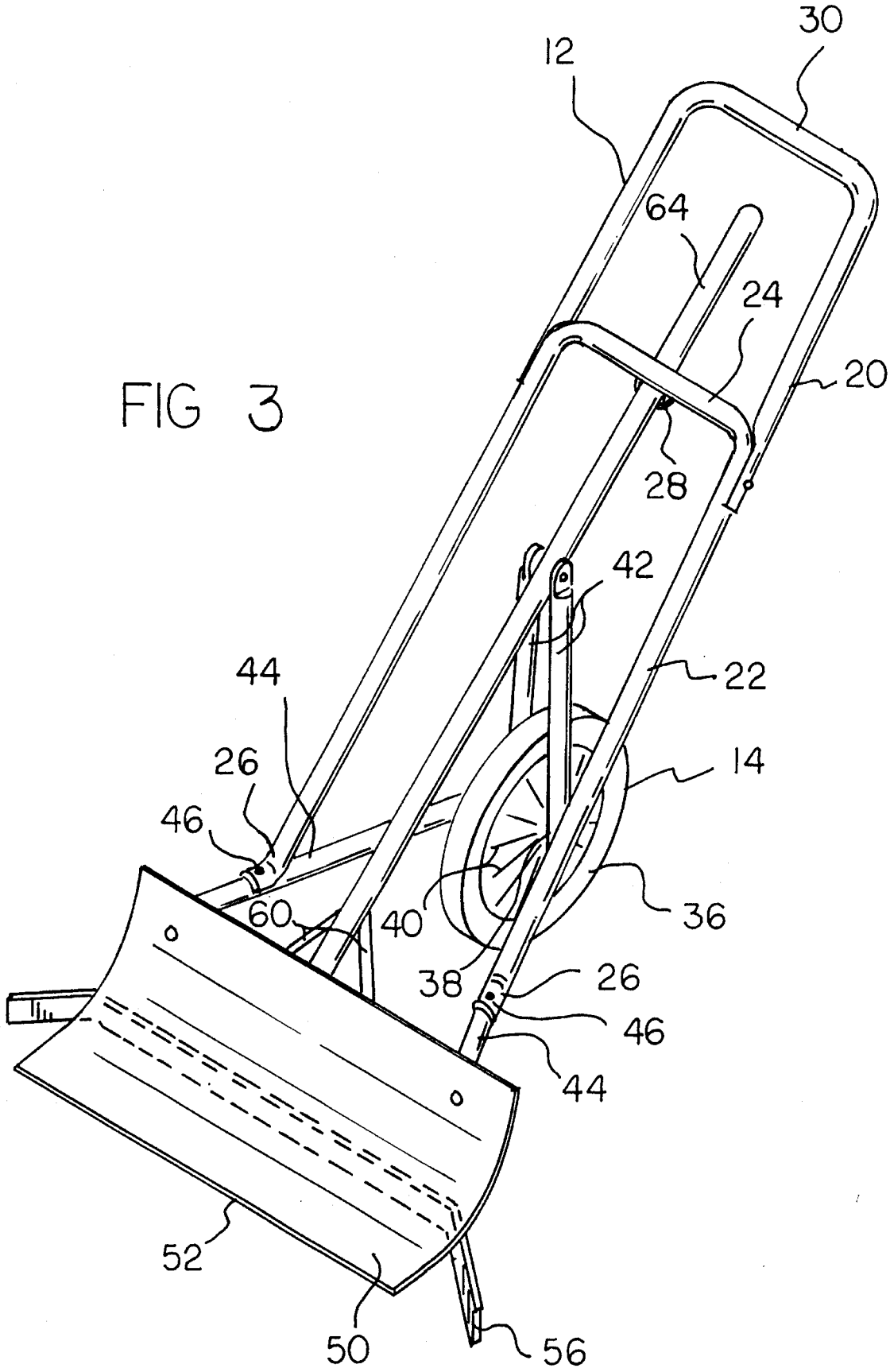
FIG. 3 is a perspective view of the preferred embodiment of the wheeled snow shoveling device constructed in accordance with the principles of the present invention.

With reference now to the drawings, and in particular to FIG. 3 thereof, the preferred embodiment of the new and improved wheeled snow shoveling device embodying the principles and concepts of the present invention and generally designated by the reference numeral 10 will be described.

The present invention, the wheeled snow shoveling device is comprised of a plurality of components. Such components in their broadest context include a cart handle 12, a cart wheel 14, and a snow shovel.

More specifically, the cart handle 12 has an upper segment 20 and a lower segment 22. The lower segment is fabricated of tubular steel and formed in a long generally inverted U-shape configuration with a horizontally positioned cross bar 24. The lower segment measures betwen two and four feet in length and is positioned at an angle of between thirty and sixty degrees with respect to the ground. The free ends 26 of the lower segment are formed as short curved planar members with screw holes extending therethrough. The apertures permit easily assembly with cooperatively coupled nuts and bolts. The lower segment also includes at least one aperture below each side of the cross bar. Note FIGS. 3, 4 and 6.

The cross bar of the lower segment of the handle includes a centrally positioned, downwardly extending steel ring 28 affixed thereto. The upper segment of the handle is fabricated of tubular steel and formed in a generally inverted U-shape configuration with a horizontally positioned cross bar 30. The free ends of the upper segment are formed as planar members with at least one aperture. The upper segment of the handle is coupled to the lower segment with cooperatively coupled nuts and bolts through the aligned apertures. The upper segment provides a clearance area for the shaft of the snow shovel in the operative orientation. The entire extent of the upper segment is covered with a layer of foam rubber padding 32 to provide a comfortable gripping surface for the user. Note FIGS. 6 and 7.

A cart wheel 14 is formed of a solid rubber circular tire 36 measuring between twelve and eighteen inches in diameter. The large size of the wheel helps provide the proper angle for easy operation of the apparatus. A cylindrically shaped axle 38 is positioned at the axis of the wheel. The axle includes end bolts extending from both of its free ends. A plurality of spokes 40 connect the axle and rubber tire therebetween. The cart wheel includes a pair of vertical support bars 42 formed in a generally tubular configuration with flat ends which have circular apertures extending therethrough. A first free end of each vertical support bar is positioned upon an end bolt of the axle. The solid rubber and spoked construction of the wheel enhances the strength and durability of the apparatus. Note FIG. 3.

The cart wheel includes a pair of horizontal braces 44 formed in a generally tubular configuration with flat ends which having circular apertures extending therethrough. A first free end of each brace is positioned on an end bolt of the axle. A second free end 46 of each brace is bent to form an L-shape configuration. The center point of each brace includes a screw hole extending therethrough. The lowermost extent of the lower segment of the handle is coupled to the braces with nuts and bolts through the aligned screw holes. The first free ends of the braces and support bars are securely fastened to the axle end bolts with cooperatively coupled nuts. The sturdy construction of the cart wheel provides a reliable pivot point for the apparatus. Note FIG. 3.

A snow shovel has a scoop 50 which is fabricated of steel and formed as a generally rectangular shaped member molded into a semi circular configuration. The scoop has a concave front surface and a convex rear surface. The upper region of the shovel includes two apertures. The rear surface of the scoop is coupled to the free ends of the braces of the cart wheel with nuts and bolts through the aligned apertures. The interconnected assembly provides strength and durability to the apparatus. The lowermost edge of the scoop 52 is positioned a short distance above the ground in the operative orientation. This configuration allows the user to effortlessly scoop the majority of snow from a desired surface while averting the risk of getting the scoop caught in driveway or sidewalk expansion cracks. Note FIGS. 3 and 4.

The approximate center point of the rear surface of the scoop includes a downwardly extending rubber squeegee 56 affixed thereto. The squeegee is positioned across the rear surface of the scoop with its ends extending beyond both ends of the scoop in a frontwardly angled orientation. Note FIG. 3. The flexible rubber squeegee is adapted to prevent the apparatus from getting caught in sidewalk or other surface cracks during use. The squeegee serves to push aside some of the residual snow left behind by the scoop. Additionally, the flexible rubber construction of the squeegee prevents loud scraping noises from occuring. The scoop includes a hollow, generally cylindrical shaped shaft mount 58 affixed to the upper portion of its rear surface. The shaft mount includes a screw hole and two angled support rods 60 extending therefrom. The support rods are affixed to the rear surface of the scoop. The shaft mount enhances the strength and stability of the apparatus. Note FIGS. 3 and 4.

A long cylindrical shaped wooden shaft 64 is coupled within the shaft mount with a screw. The shaft extends through the circular ring on the cross bar of the lower segment of the handle. The approximate center point of the shaft includes an aperture extending therethrough. The second ends of the vertical support bars are coupled to the approximate center point of the shaft with a nut and bolt through the aligned apertures. The shaft of the snow shovel and cart handle are angled at between about thirty and sixty degrees in the operative orientation. The clearance area between the upper and lower cross bars prevents injury to users due to jarring of the shovel during use. The angle of the apparatus coupled with its wheeled construction permit the user to effortlessly shovel light snow accumulations in the operative orientation. Note FIG. 3.

The wheeled snow shoveling device removes light snow rapidly and easily with a minimum of physical effort. It is particularly easy on the back. It helps prevent back injuries and eleviates the possibility of aggravating a previously existing one. The shovel is mounted on a lightweight cart, so it can be pushed along rather than carried.

The shovel is of the scoop type, and is about thirty inches in width to minimize the number of passes which must be taken while removing snow. The squeegee is made of flexible rubber and serves to scoop up excess snow down to the pavement. The flexibility of the squeegee prevents it from catching on cracks that could abruptly jar the user when encountered. It also reduces the noise level as it scrapes along the pavement.

The cart is made of tubular steel with its wheel being mounted between the support brackets and braces. The wheel is fabricated of sturdy solid rubber and is approximately sixteen inches in diameter. The handle is well padded for comfort and insulation.

The wheeled snow shoveling device is adapted to scoop snow for eventual disposal in a desired area. Rather than lifting the shovel, the cart tilts easily on the wheel so it can be moved and dropped along the side of the pavement. Even a user dressed in business attire can easily push the snow out of the way before driving off to work. The sleek construction of the apparatus prevents the user from having to exert the type of physical effort that would disturb their appearance or require a change of clothing.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved wheeled snow shoveling device comprising, in combination:

a cart handle having an upper segment and a lower segment, the lower segment fabricated of tubular steel and formed in a long generally inverted U-shape configuration with a horizontally positioned cross bar, the ends of the lower segment being formed as short curved planar members with screw holes extending therethrough, the lower segment also including at least one aperture below each side of the cross bar, the cross bar including a centrally positioned downwardly extending steel ring affixed thereto, the upper segment of the handle fabricated of tubular steel and formed in a generally inverted U-shape configuration with a horizontally positioned cross bar, the ends of the upper segment formed as planar members with at least one aperture, the upper segment of the handle being coupled to the lower segment with nuts and bolts through the apertures in the ends of the upper segment and the apertures below each side of the cross bar, a portion of the upper segment being covered with a layer of foam rubber padding to provide a comfortable gripping surface for the user;

a cart wheel formed of a solid rubber circular tire measuring between twelve and eighteen inches in diameter, a cylindrically shaped axle with two free ends being positioned at the axis of the wheel, the axle including first and second end bolts extending from its free ends, a plurality of spokes connecting the axle and rubber tire therebetween, the cart wheel including first and second vertical support bars formed in a generally tubular configuration, each vertical support bar having two flat ends, each flat end having a circular aperture extending therethrough, a first end of the first vertical support bar being positioned upon the first end bolt of the axle, a first end of the second vertical support bar being positioned upon the second end bolt of the axle, the cart wheel including first and second horizontal braces formed in a generally tubular configuration, each horizontal brace having two flat ends, each flat end of each horizontal brace having a circular aperture extending therethrough, a first end of the first horizontal brace being positioned on the first end bolt of the axle, a first end of the second horizontal brace being positioned on the second end bolt of the axle, a second end of each horizontal brace being belt to form an L-shape configuration, a center point of each horizontal brace including a screw hole extending therethrough, the ends of the lower segment of the handle being coupled to the horizontal braces with nuts and bolts through the screw holes in the center point of the horizontal braces an the screw holes in the free ends of the lower segment of the handle, the first ends of the horizontal braces and the vertical support bars being securely fastened to the axle bolts with cooperatively coupled nuts; and a snow shovel having a scoop fabricated of steel and formed as a generally rectangular shaped member molded into a semi circular configuration with at least two ends, the scoop having a concave front surface and a convex rear surface, an upper region of the shovel including two apertures, the rear surface of the scoop being coupled to the second ends of the horizontal braces of the cart wheel with nuts and bolts through the apertures at the upper region of the shovel and the apertures of the second ends of the horizontal braces, a the lowermost edge of the scoop being positioned a short distance above the ground in an operative orientation, an approximate center point of the rear surface of the scoop including a downwardly extending rubber squeegee affixed thereto, the squeegee having at least two ends, the squeegee positioned across the rear surface of the scoop with its ends extending beyond both ends of the scoop in a frontwardly angled orientation, the rubber squeegee adapted to prevent the device from getting caught in cracks while in use, the scoop including a hollow generally cylindrically shaped shaft mount affixed to an upper portion of its rear surface, the shaft mount including a screw hole and two angled support rods extending therefrom and affixed to the scoop, a long cylindrically shaped wooden shaft being coupled within the shaft mount with a screw, the shaft extending through the ring on the cross bar of the lower segment of the handle, the approximate center point of the shaft including an aperture extending therethrough, the second ends of the vertical support bars being coupled to the approximate center point of the shaft with a nut and bolt through the aperture in the approximate center point of the shaft and the apertures in second ends of the vertical support bars, the shaft of the snow shovel and cart handle being angled at between about thirty and sixty degrees from a vertical plane in the operative orientation.

2. A cart mounted snow shoveling device comprising:

a cart having a handle formed in a generally A-shaped configuration with a lowermost extent and an upper portion, the cart including a cross bar having a circular ring extending from the crossbar, the cart including a wheel with an axle positioned at its axis, the wheel including a pair of vertical support bars, one end of each of the vertical support bars is affixed to the axle, the wheel also including a pair of horizontal braces having free ends affixed to its axle, the lowermost extent of the handle being coupled to the braces; and a snow shovel having a scoop formed as a generally rectangular shaped member and molded into a semi circular configuration, the scoop having two side ends, a rear surface of the scoop being coupled to the free ends of the horizontal braces of the cart wheel, the scoop having a wooden shaft affixed to its rear surface, the shaft extending through the circular ring on the cross bar of the handle, the other ends of the vertical support bars being coupled to the shaft.

3. The device as set forth in claim 2 wherein a lower edge of the scoop is positioned a short distance above the ground: and the rear surface of the scoop includes a downwardly extending rubber squeegee affixed thereto, the squeegee having side ends and being positioned across the rear surface of the scoop with its ends extending beyond both side ends of the scoop in a frontwardly angled orientation, the rubber squeegee adapted to prevent the device from getting caught in cracks during use.

4. The device as set forth in claim 2 wherein the upper portion of the cart handle includes a layer of foam rubber padding positioned therearound.

5. The device as set forth in claim 2 wherein the vertical support bars and horizontal braces are coupled to the snow shovel with nuts and bolts.

* * * * *